US011739391B2

(12) United States Patent
Lopes

(10) Patent No.: US 11,739,391 B2
(45) Date of Patent: Aug. 29, 2023

(54) LANCE FOR USE IN METAL PRODUCTION AND CASTING INSTALLATIONS

(71) Applicant: VESUVIUS REFRATARIOS LTDA., Piedade (BR)

(72) Inventor: Joao Altenir Lopes, Volta Redonda (BR)

(73) Assignee: Vesuvius Refratarios Ltda., Piedade (BR)

( * ) Notice: Subject to any disclaimer, the term of this patent is extended or adjusted under 35 U.S.C. 154(b) by 0 days.

(21) Appl. No.: 17/778,562

(22) PCT Filed: Jan. 8, 2021

(86) PCT No.: PCT/EP2021/050296
§ 371 (c)(1),
(2) Date: May 20, 2022

(87) PCT Pub. No.: WO2021/140214
PCT Pub. Date: Jul. 15, 2021

(65) Prior Publication Data

US 2022/0411889 A1 Dec. 29, 2022

(30) Foreign Application Priority Data

Jan. 9, 2020 (BR) ..... BR102020000554.5
Jan. 10, 2020 (BR) ..... BR202020000580.0
Jan. 13, 2020 (BR) ..... BR102020000704.1

(51) Int. Cl.
*C21C 5/46* (2006.01)
*F27D 21/00* (2006.01)

(52) U.S. Cl.
CPC ..... *C21C 5/4613* (2013.01); *F27D 21/0014* (2013.01)

(58) Field of Classification Search
CPC ..... C21C 5/4673; C21C 5/32; C21C 5/4613; F27D 21/0014; F27D 21/00; F27D 19/00; G01N 1/125; G01N 33/205
(Continued)

(56) References Cited

U.S. PATENT DOCUMENTS 4,566,343 A * 1/1986 Theuwis ..... G01K 13/125
374/E13.013
5,241,262 A * 8/1993 Guthrie ..... G01N 15/12
324/717

(Continued)

FOREIGN PATENT DOCUMENTS

EP 3588052 A1 1/2020
JP H07218155 A 8/1995
KR 101597688 B1 2/2016

*Primary Examiner* — Jessee R Roe
*Assistant Examiner* — Michael Aboagye
(74) *Attorney, Agent, or Firm* — MaxGoLaw PLLC

(57) ABSTRACT

The present invention concerns a lance composed of a top lance (1*t*) and of a sublance (2) coupled to the top lance (1*t*), which forms a shoulder (1*s*) between the top lance and the sublance. The sublance (2) of the present invention is provided with a protective device (3) comprising a coupling end (2*c*) opening to the cavity (2*v*), wherein, when at rest, the protective device (3) is in an initial configuration characterized by an outer maximum diameter (D3*o*) which is not more than 10% larger than the diameter (D2) of sublance (2) (D3*o*≤1.1 D2), when the sublance (2) is coupled to the lance the protective device (3) contacts the shoulder (1*s*) and is deformed into a deformed configuration, forming a surface impervious to molten metal and slag, which spans over a whole area of the shoulder (1*s*).

16 Claims, 5 Drawing Sheets

(58) Field of Classification Search
USPC ..... 266/287, 225, 87, 89, 99; 374/140; 73/864.59, 866.5
See application file for complete search history.

(56) References Cited

U.S. PATENT DOCUMENTS

| | | | | |
|---|---|---|---|---|
| 7,370,544 | B2 * | 5/2008 | Neyens | G01K 13/125 374/E13.013 |
| 9,909,810 | B2 * | 3/2018 | Broekmans | C21C 5/00 |
| 10,428,399 | B2 * | 10/2019 | Sasso | G01N 1/1409 |

* cited by examiner

LANCE FOR USE IN METAL PRODUCTION AND CASTING INSTALLATIONS

CROSS-REFERENCE TO RELATED APPLICATIONS

This application is the National Stage application of International Application No. PCT/EP2021/050296, filed Jan. 8, 2021, which claims the benefit of Brazilian Patent Application No. BR102020000554.5, filed Jan. 9, 2020, and of Brazilian Patent Application No. BR202020000580.0, filed Jan. 10, 2020, the contents of each of which are incorporated by reference into this specification.

TECHNICAL FIELD

The present invention concerns a lance for immersion of a probe into molten metal contained in a metallurgical vessel, such as a converter for making steel. The lance is of the type comprising a top lance, which is reusable and does not contact the molten metal, and a sublance coupled to the top lance and holding at a free end thereof a probe for measuring parameters of the molten metal, and/or a sampling tool for collecting a sample of molten metal. In use, the sublance is immersed partially into the molten metal and is disposable. The connection between the top lance and the sublance defines a shoulder, since the top lance has a larger diameter than the sublance. If molten metal splatters onto the shoulder of the top lance, it may, once solidified, jeopardize the coupling of a new sublance to the top lance. The present invention proposes a sublance provided with a protecting device preventing splattering of molten metal or slag onto the shoulder region of the top lance. To facilitate storing of the sublances in existing racks, and for handling the sublances by a robot without changing the programming of the robot, the protecting device stored in the rack has a diameter similar to the diameter of the sublance.

BACKGROUND OF THE INVENTION

Metal production processes are carried out in metallurgical vessels at high temperatures, undergoing chemical or physical reactions, whether desired or undesired, during the residence time or transfers from one vessel to another of molten metal and/or slag. Since the properties of the final metal products thus produced are strongly dependent on the process conditions, including temperature, pH, and on whether or not desired and undesired chemical or physical reactions occurred, it is important to measure such parameters and also to collect samples in situ, for further characterization. This is generally carried out with a lance comprising a top lance which remains out of the molten metal or slag and a sublance coupled to the top lance and provided with a probe and/or a sample collector at a free end thereof. The top lance is generally made of metal or polymer and is reusable. The sublance, on the other hand, is generally made of thick cardboard and is disposable.

For example, steel can be produced from carbon-rich molten pig iron by an oxygen converter process, wherein oxygen is blown with a lance (12) through molten pig iron to lower the carbon content of the alloy and to change it into low-carbon steel (cf. FIG. 1). In this process, samples are collected, and parameters of the melt measured with different sublances at least during oxygen blowing (sometimes referred to as inblow sublance) and after oxygen blowing (sometimes referred to as endblow sublance), to ensure that steel of the desired quality is obtained. The inblow sublances are typically provided with a sensor that can measure a temperature and a liquidus of the molten metal and with a sample collector for retrieving a sample of metal. The endblow sublances are typically provided with a sensor for measuring a temperature and an oxygen content of the molten metal and with a sample collector for retrieving a sample of metal.

A new sublance is inserted over a coupling portion of the top lance until it reaches a shoulder formed by a handling portion of the top lance which has a diameter larger than the sublance. Because of vibrations during use, it is possible that the sublance loses contact with the shoulder forming a small gap. The molten metal (11) or the slag floating at the surface thereof can be agitated, either because a vessel is in movement or, in case of a steelmaking converter, because oxygen is being sparged, creating splatters (11*s*) which can reach a top of the sublance and even the shoulder or, if there is one, a gap between said shoulder and the top of the sublance. The metal or slag splatters solidify and form incrustations at the surface of the shoulder and/or of the coupling portion at the level of the gap. When the current sublance is retrieved from the top lance and disposed of, it is important to scrape off any solid metal incrustation from the surfaces of the shoulder and coupling portion of the top lance lest a next sublance cannot be coupled properly to the top lance.

U.S. Pat. No. 4,566,343 and EP3588052 describe solutions for preventing the formation of metal incrustations at a gap between the sublance and the shoulder. U.S. Pat. No. 4,566,343 describes an elastic ring seal between the immersion end of the shoulder of the top lance and the top of the sublance to reduce the deposition of frozen metal at the joint between the top lance and the sublance. EP3588052 describes a similar solution, using two elastic ring seals arranged at the end portion of the sublance, wherein the two elastic ring seals are arranged circumferentially on top of each other for sealing a space between the coupling tap and the end portion of the sublance. These solutions protect a gap between the sublance and the shoulder from being reached by metal or slag splatters. As mentioned supra, a gap does not necessarily occur, and these solutions do not protect the shoulder from metal splattering.

KR101597688 proposes a solution for protecting the shoulder of the top lance from metal splattering. The top end of the sublance is provided with an anti-stick cover formed by an inner ring comprising an inner passage suitable for engaging into the coupling portion of the top lance, and an outer ring, coaxial with and separate from the inner ring, having a larger diameter than the inner ring, which matches the diameter of the shoulder and protects it from metal splattering. The problem with this solution is that the outer ring has a diameter substantially larger than the diameter of the sublance. It follows that the racks traditionally used for storing new sublances awaiting their utilization cannot be used anymore without amending the dimensions of the receiving means to match the dimensions of the anti-stick covers. Furthermore, the change of the geometry of the top end of the sublance with the coupling of the anti-stick cover may require a change in the programming of the robots used for handling the sublances and for coupling them to or retrieving them from the top lance.

The present invention proposes a solution for protecting the shoulder of a top lance as well as any gap formed between said shoulder and a sublance, maintaining the geometry of the top of the sublance substantially unamended. This solution has the advantage that it can be implemented by replacing one-to-one existing sublances without requiring any design change of the existing racks used for storing the sublances and with no programming change of the robots used to handle the sublances. The solution has the advantage that the conformance of the protecting device to a surface of the top lance and conformance to a surface of the sublance is the result of the deformation of the entire device, rather than the deformation of a surface of an elastic material." and "This solution has the advantage that the expandable radially protective device expands only after the top lance and sublance have been joined axially, thus reducing the possibility of damage during handling and assembly. These and other advantages of the present invention are presented in continuation.

SUMMARY OF THE INVENTION

The present invention is defined in the appended independent claims. Preferred embodiments are defined in the dependent claims. In particular, the present invention concerns a lance for immersion of a probe into molten metal comprising, (A) a top lance comprising, a handling portion extending along a longitudinal axis (X), and comprising a distal end of cross-section normal to the longitudinal axis (X) of diameter (D1) the distal end being provided with a coupling portion extending coaxially with the longitudinal axis (X), and having a maximum diameter (d1), with D1>d1, (B) a sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end opening to the cavity, wherein, the elongated tube has a cross-section of external diameter (D2) wherein d1<d2<D2<D1, and the protective device is deformable upon application thereto of a force along the longitudinal axis (X), and the coupling portion is inserted in the cavity of the sublance with the protective device contacting the shoulder, wherein, when at rest, the protective device is in an initial configuration characterized by an outer maximum diameter (D3*o*) which is not more than 10% larger than D2 (D3*o*≤1.1 D2), preferably not more than 5% larger than D2 (D3*o*≤1.05 D2), more preferably D3*o*=D2, when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3*d*) with D3*d* D1, covering a whole area of the shoulder.

In a first embodiment, the protective device comprises, an inner tube which is deformable upon application thereto of a compressive force along the longitudinal axis (X), the inner tube extending along the longitudinal axis (X) and forming an inner passage of diameter (D3*i*) with D3*i*≥d1, the inner layer comprising a number of inner slits separated from one another and distributed over a circumference of the inner tube, an outer tube which is deformable upon application thereto of a compressive force along the longitudinal axis (X), the outer tube snugly surrounding the inner tube and comprising a number of outer slits separated from one another and distributed over a circumference of the outer tube, optionally, one or more peripheral tubes which are deformable upon application thereto of a compressive force along the longitudinal axis (X), and which are inserted in one another and snugly surrounding the outer tube (3*o*) and wherein each of the one or more peripheral tubes comprises a number of peripheral slits separated from one another and distributed over a circumference of each of the one or more peripheral tubes, wherein the peripheral slits (3*i*) of two adjacent peripheral tubes do not overlap with one another at any point, and wherein the outer slits (3*o*) do not at any point overlap with the peripheral slits of the peripheral tube adjacent to the outer tube, and wherein the inner slits (3*i*) and the outer slits (3*o*) do not overlap with one another at any point.

It is preferred that the inner slits and outer slits preferably extend parallel to the longitudinal axis (X). In an alternative embodiment, the inner slits and outer slits extend transverse to, but not normal to the longitudinal axis (X), and wherein the inner slits and outer slits form an angle with the longitudinal axis preferably comprised between 10 and 50°, more preferably between 25 and 45°. The inner tube and outer tube can be made of an elastomeric material, or of a metal which is plastically deformable, or can be in the form of a fabric of woven or non-woven fibres made of ceramic, polymer, or metal fibres. To enhance the reproducibility of the deformation of the protective device, the inner tube and/or the outer tube can be provided with folding lines to control the deformation of the protective device (3) for folding in a reproducible way. The inner tube and the outer tube can have different heights measured along the longitudinal axis (X).

In a second embodiment, the protective device may comprise a tube which is deformable upon application thereto of a compressive force along the longitudinal axis (X). The tube extends along the longitudinal axis (X) and forms an inner passage of diameter (D3*i*) with D3*i*≥d1. The tube comprises a number of slits separated from one another and distributed over a circumference of the tube. In a preferred embodiment, the slits can be distributed in two sets, an upper set extending from a location adjacent to the coupling end to a location adjacent to a half of a height of the tube measured along the longitudinal axis (X), and a lower set extending from a location adjacent to a fixed end opposite the coupling end to location adjacent to the half of the height of the tube, wherein the slits of the upper set are offset relative to the slits of the lower set.

The protective device of the foregoing first and second embodiment can be cylindrical, or can comprise one or more cylindrical portions and one or more tapered or curved portions distributed along the longitudinal axis (X).

In a third embodiment, the protective device comprises, a support ring coupled to the proximal end of the elongated tube, and a number of L-shaped plates, each comprising an outer portion joined to an inner portion at a level of a corner of the L, the L-shaped plates being rotatably mounted and distributed about a circumference of the support ring by hinges at the level of or adjacent to the corners of the L-shaped plates, such that in the initial configuration of the protective device each L-shaped plate is biased to rotate such that the inner portions extend radially inwards, substantially normal to the longitudinal axis (X), obturating at least partially the cavity and the outer portions rest against an outer surface of the sublance, and the L-shaped plates are configured for pivoting about the hinges (3*h*) from the initial configuration to the deformed configuration upon inserting the coupling portion (1*c*) into the cavity to couple the sublance to the top lance, wherein in the deformed configuration, the inner portions are aligned parallel to the longitudinal axis (X) and the outer portions extend radially, substantially normal to the longitudinal axis (X) and overlap with one another to form a continuous screen against splashes when the protective device is brought into contact with the shoulder.

It is preferred that each outer portion has a free edge which is larger than the corner, measured normal to the longitudinal axis (X), and wherein each outer portion is curved with a curvature matching the external diameter (D2) of the coupling end, such that when the protective device is in the initial configuration, each outer portion mates an external surface of the sublance.

Similarly, it is preferred that each inner portion has a free edge which is shorter than the corner, measured normal to the longitudinal axis (X), and wherein each inner portion is curved with a curvature matching the maximum diameter (d1) of the coupling portion, such that upon inserting the coupling portion into the cavity and upon pivoting the L-shaped plates over their hinges, the inner portions are pressed against a wall of the cavity and form an inner passage of diameter (D3*i*) with D3*i*≥d1, allowing the insertion of the coupling portion.

The L-shaped plates are preferably rigid enough to not substantially deform upon normal use of the device, and are preferably made of metal, preferably steel or aluminium, or made of a ceramic material, or made a polymeric material.

The present invention also concerns a sublance for coupling to the coupling portion of the lance as defined supra. The sublance is formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device (3) comprising a coupling end (2*c*) opening to the cavity (2*v*). The sublance is characterized as follows, the elongated tube has a cross-section of external diameter (D2) wherein d1<d2<D2<D1, and the protective device is deformable upon application thereto of a force along the longitudinal axis (X), and the coupling portion is inserted in the cavity of the sublance with the protective device contacting the shoulder, when at rest, the protective device is in an initial configuration characterized by an outer maximum diameter (D3*o*) which is not more than 10% larger than D2 (D3*o*≤1.1 D2), preferably not more than 5% larger than D2 (D3*o*≤1.05 D2), more preferably D3*o*=D2, when the sublance is coupled to the lance with the coupling portion being inserted in the cavity, the protective device contacts the shoulder and is deformed into a deformed configuration, forming a surface impervious to molten metal and slag, which spans over an area inscribing a circle of diameter (D3*d*) with D3*d*≥D1, covering a whole area of the shoulder, extending normal to the longitudinal axis (X) over a distance at least equal to ½D1 from the longitudinal axis (X).

The protective device is preferably as defined in the first, second, or third embodiments described supra.

The present invention also concerns a protective device for protecting from splattering the shoulder formed between the distal end of the handling portion and the sublance of a lance as defined supra. The protective device comprises, an inner tube which is deformable upon application thereto of a compressive force along the longitudinal axis (X), the inner tube extending along the longitudinal axis (X) and forming an inner passage of diameter (D3*i*) w with D3*i*≥d1, the inner layer comprising a number of inner slits separated from one another and distributed over a circumference of the inner tube, an outer tube which is deformable upon application thereto of a compressive force along the longitudinal axis (X), the outer tube snugly surrounding the inner tube and comprising a number of outer slits separated from one another and distributed over a circumference of the outer tube, optionally, one or more peripheral tubes which are deformable upon application thereto of a force along the longitudinal axis (X), and which are inserted in one another and snugly surrounding the outer tube and wherein each of the one or more peripheral tubes comprises a number of peripheral slits separated from one another and distributed over a circumference of each of the one or more peripheral tubes, wherein the peripheral slits (3*i*) of two adjacent peripheral tubes do not overlap with one another at any point, and wherein the outer slits do not at any point overlap with the peripheral slits of the peripheral tube adjacent to the outer tube, and wherein the inner slits and the outer slits do not overlap with one another at any point.

The protective device is preferably as defined in the first, second, or third embodiments described supra.

BRIEF DESCRIPTION OF THE FIGURES

For a fuller understanding of the nature of the present invention, reference is made to the following detailed description taken in conjunction with the accompanying drawings in which:

FIG. 2(*b*) shows a top lance of the present invention, formed by the handling portion and the coupling portion of FIG. 1(*a*) coupled to one another.

FIG. 2(*c*) shows a sublance according to the present invention.

FIG. 2(*d*) shows a lance according to the present invention formed by the sublance of FIG. 2(*c*) coupled to the top lance of FIG. 2(*b*).

FIG. 2(*e*) shows a sublance according to the present invention.

FIG. 3(*b*) shows the protecting device of FIG. 3(*a*) in assembled form.

FIG. 3(*c*)-3(*f*) show alternative embodiments of protective devices according to the present invention.

FIG. 4(*b*) shows a detail of the assembled top lance of FIG. 4(*a*) over a sublance provided with a protective device of the type illustrated in FIGS. 3(*a*) to 3(*f*).

FIG. 4(*c*) shows the sublance of FIG. 4(*b*) partially inserted over the coupling portion of the top lance of FIG. 4(*b*), with a top surface of the protective device contacting the shoulder but remaining undeformed in the initial configuration.

FIG. 4(*d*) shows the sublance of FIG. 4(*c*) fully inserted over the coupling portion of the top lance of FIG. 4(*c*), with the one embodiment of protective device being deformed in the deformed configuration and protecting the shoulder from splattering.

FIG. 4(*e*) shows a partially deformed protective device of the type illustrated in FIGS. 3(*a*)-3(*f*).

FIG. 5(*b*) shows a side view of the second embodiment of the protective device of FIG. 5(*a*) in assembled form.

FIG. 5(*c*) shows the second embodiment of the protective device of FIG. 5(*b*) in the initial configuration.

FIG. 5(*d*) shows the second embodiment of the protective device of FIG. 5(*b*) in the deformed configuration.

FIG. 5(*e*) shows a sublance according to the present invention with the protective device of the second embodiment of FIG. 5(*a*).

FIG. 6(*b*) shows a detail of the assembled top lance of FIG. 6(*a*) over a sublance provided with a protective device of the type illustrated in FIGS. 5(*a*) to 5(*e*).

FIG. 6(*c*) shows the sublance of FIG. 6(*b*) partially inserted over the coupling portion of the top lance of FIG. 6(*b*), with a top surface of the second embodiment of the protective device still separated from the shoulder and already at least partially deformed by the introduction of the coupling portion.

FIG. 6(*d*); shows the sublance of FIG. 6(*c*) fully inserted over the coupling portion of the top lance of FIG. 6(*c*), with the second embodiment of protective device being deformed in the deformed configuration and protecting the shoulder from splattering.

DETAILED DESCRIPTION OF THE INVENTION

Figure 1:
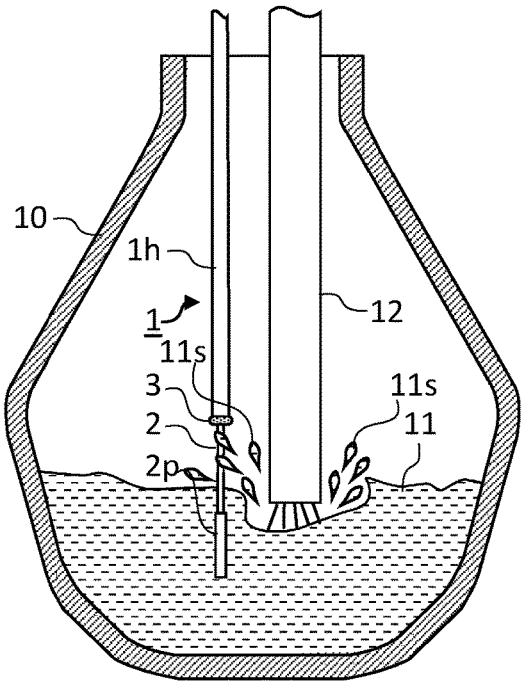
FIG. 1: shows a steelmaking converter with an oxygen lance and a lance according to the present invention.
Figure 2E:
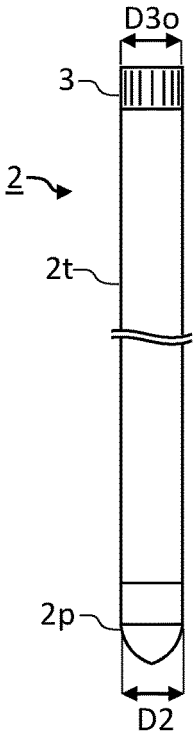
FIG. 2(*a*) shows a handling portion and a separate coupling portion of a lance according to the present invention.
Figure 2A:
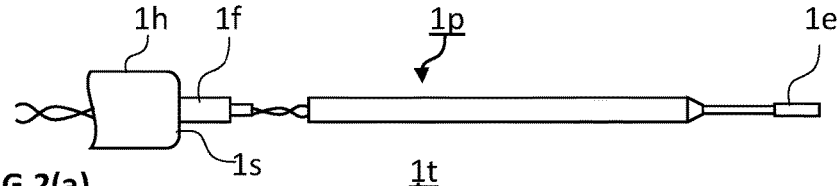
Figure 2B:
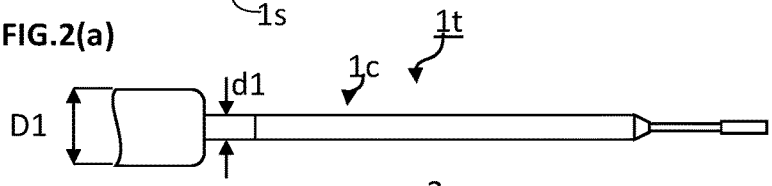
Figure 2C:
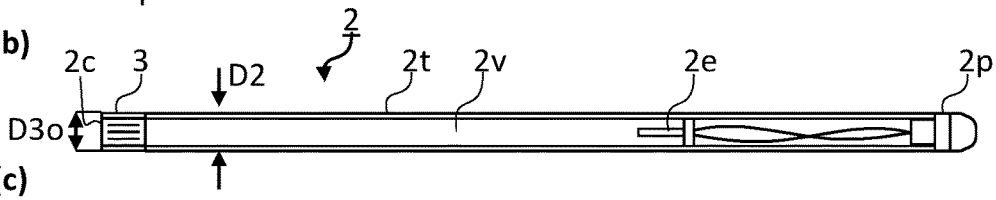
Figure 2D:
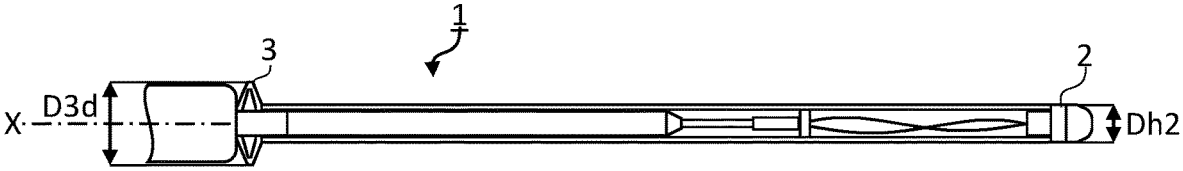
Figure 3A:
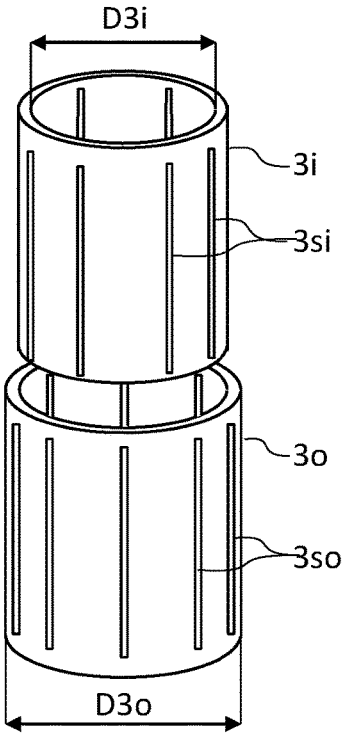
FIG. 3(*a*) shows an exploded view of an embodiment of a protecting device according to the present invention.
Figure 3B:
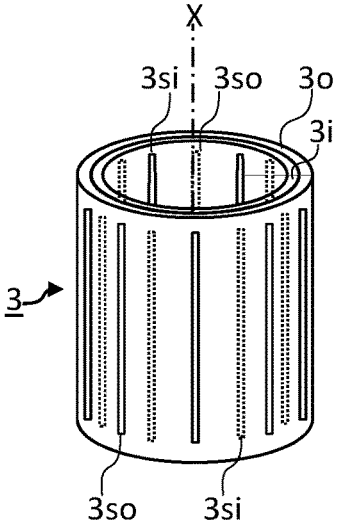
Figure 3C:
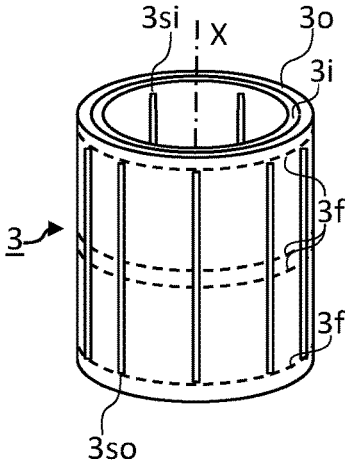
Figure 3D:
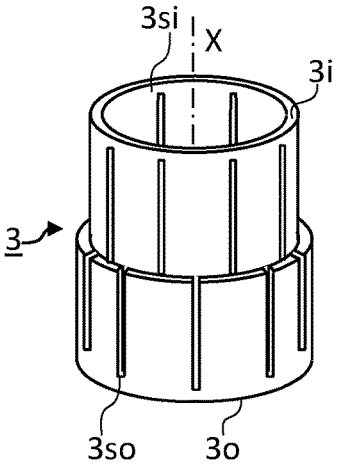
Figure 3E:
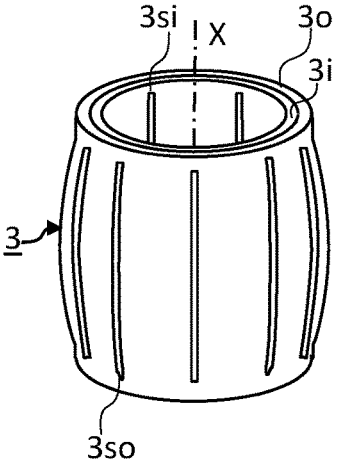
Figure 3F:
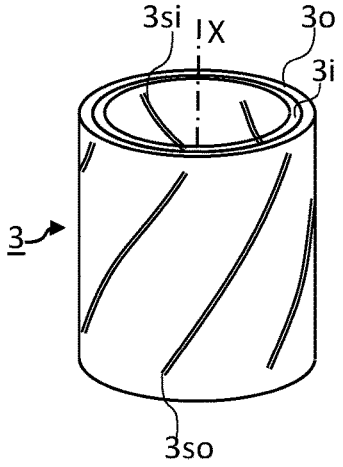
Figure 4A:
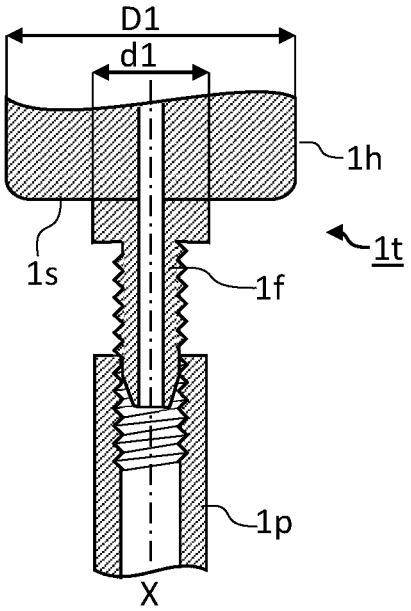
FIG. 4(*a*) shows a detail of the coupling of a coupling portion to a handling portion for forming a top lance of the present invention.
Figure 4E:
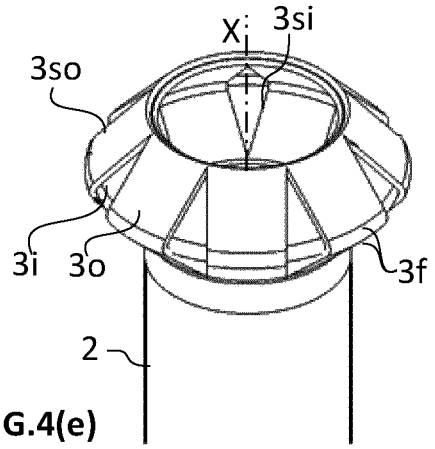
Figure 4B:
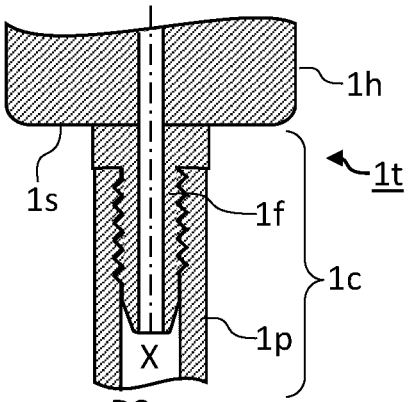
Figure 4B:
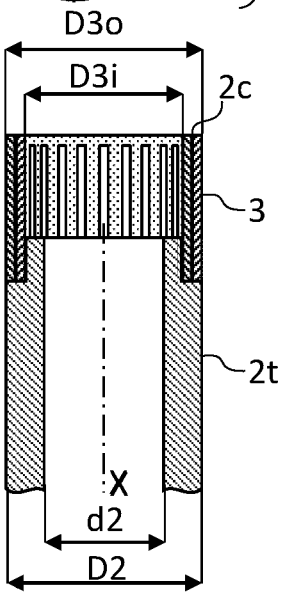
Figure 4C:
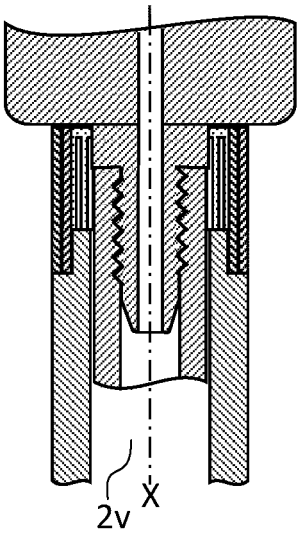
Figure 4D:
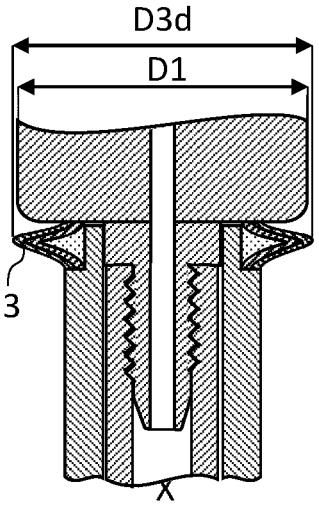
Figure 5A:
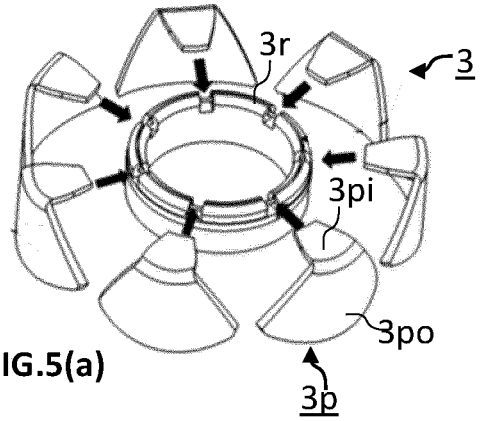
FIG. 5(*a*) shows an exploded view of a second embodiment of the protective device of the present invention.
Figure 5B:
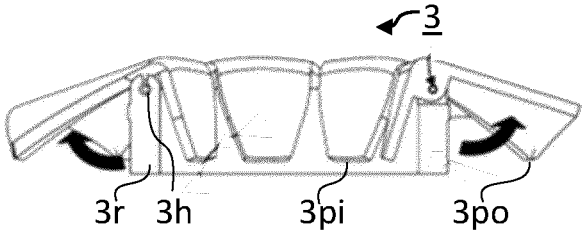
Figure 5C:
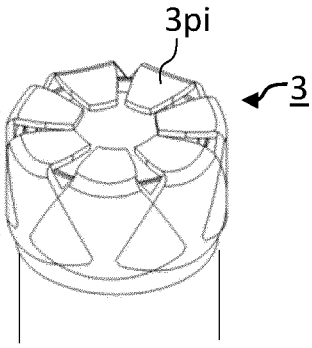
Figure 5D:
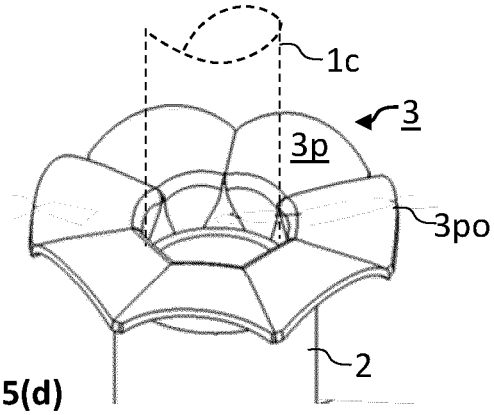
Figure 5E:
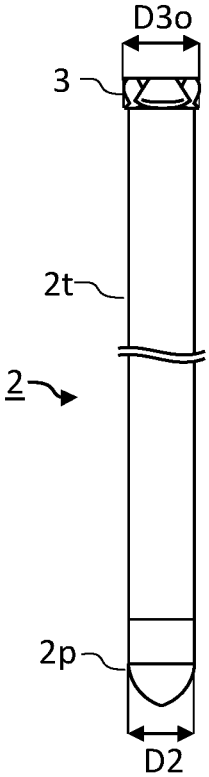
Figure 6A:
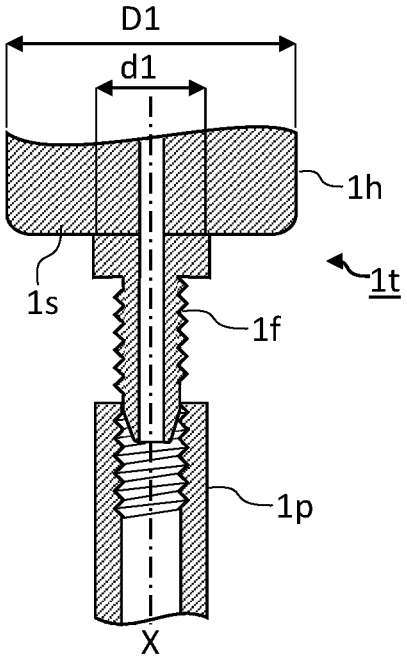
FIG. 6(*a*) shows a detail of the coupling of a coupling portion to a handling portion for forming a top lance of the present invention.

The present invention concerns a lance for immersion of a probe into molten metal. The lance comprises a top lance (1*t*) and a disposable sublance (2), holding a probe and being coupled to the top lance (1*t*).

The top lance (1*t*) comprises a handling portion (1*h*) which is reusable, and a coupling portion (1*c*) coupled to or at least partially integral with a distal end of the handling portion (1*h*). The handling portion (1*h*) extends along a longitudinal axis (X) and comprises a distal end which is generally of substantially circular cross-section normal to the longitudinal axis (X) of diameter (D1). The distal end is provided with the coupling portion (1*c*), which extends coaxially with the longitudinal axis (X), and has a maximum diameter (d1), with D1>d1. The coupling portion is generally formed by,

- a fixed element (1*f*) fixed to or integral with the distal end of the handling portion (1*h*) and defining an exposed area of the distal end forming a shoulder (1*s*), and a probe holder (1*p*) extending along the longitudinal axis (X) and comprising a proximal end reversibly coupled to the fixed element (1*f*).

A given probe holder can be used a number of times without replacement, but because of the severe conditions of use it is exposed to, it degrades rapidly and, unlike the handling portion (1*h*) and the fixed element (1*f*), the probe holder needs be replaced at regular intervals.

The sublance (2) is disposable and is formed by an elongated tube (2*t*) extending along the longitudinal axis (X) and comprising a cavity (2*v*) configured for snugly receiving the coupling portion (1*c*). The cavity is substantially cylindrical of diameter (d2), with d1<d2, extending along the longitudinal axis (X) from an immersion end provided with a probe (2*p*) and/or a sample collector, to a proximal end which is coupled to a protective device (3) comprising a coupling end (2*c*) opening to the cavity (2*v*). The elongated tube (2*t*) has a substantially circular cross-section of external diameter (D2) wherein d1<d2<D2<D1. The protective device (3) is deformable upon application thereto of a force along the longitudinal axis (X). The sublance (2) is reversibly coupled to the top lance (1*t*) to form the lance. Coupling the sublance (2) to the top lance (1*t*) to form the lance of the present invention is achieved by inserting the coupling portion (1*c*) of the top lance (1*t*) into the cavity (2*v*) of the sublance (2) with the coupling end (2*c*) of the protective device (3) contacting the shoulder (1*s*).

The gist of the present invention is to provide a protective device which, on the one hand,

- does not alter substantially the geometry of the coupling end (2*c*) of a separate (uncoupled) sublance, to allow using existing racks for storing the sublances and using robots without modifying the programming thereof and, on the other hand,
- covers and protects from splattering the whole area of the shoulder and of any gap formed between the shoulder (1*s*) and the sublance (2) when the latter is coupled to the former.

This is achieved by designing the protective device such that

- when at rest, the protective device (3) is in an initial configuration characterized by an outer maximum diameter (D3*o*) which is not more than 10% larger than D2 (D3*o*≤1.1 D2), preferably not more than 5% larger than D2 (D3*o*1.05 D2), more preferably D3*o*=D2, and
- when the sublance (2) is coupled to the lance with the coupling portion (1*c*) being inserted in the cavity (2*v*), the protective device (3) contacts the shoulder (1*s*) and is deformed into a deformed configuration, forming a surface impervious to molten metal and slag, which spans over an area inscribing a circle normal to the longitudinal axis (X) of diameter (D3*d*) with D3*d*≥D1; in the deformed configuration the protective device (3) covers a whole area of the shoulder (1*s*), extending normal to the longitudinal axis (X) over a distance at least equal to ½D1 from the longitudinal axis (X).

Top Lance (1*t*)

The top lance (1*t*), as shown in FIG. 1, is a hollow rod, sufficiently long for being inserted into a metallurgic vessel. For example, for steelmaking converters, the top lance (1*t*)

can be 10 to 20 meters long, and even longer depending on the dimensions of the metallurgic installation. It is handled by a robot configured for pulling the lance down into and up out of a metallurgic vessel. The top lance is formed of a handling portion (1*h*) and a coupling portion (1*c*).

The handling portion (1*h*) extends along a longitudinal axis (X) and comprises a distal end of substantially circular cross-section normal to the longitudinal axis (X) of diameter (D1). In a vast majority of cases, the cross-section of the distal end is circular, but in case it was not circular, the cross-section can be similarly characterized by a hydraulic diameter (Dh1) (not shown in the Figures) instead of the diameter (D1), wherein Dh1=A1/P1, with A1 and P1 being an area and a perimeter of the cross-section of the distal end normal to the longitudinal axis (X). The circularity of the cross-section of the distal end of the handling portion is not essential to the present invention. But in practice, it generally is circular.

The handling portion (1*h*) can be made of metal or polymer, or of a fibre reinforced polymer composite. It is designed to last over a substantial service time without being changed. It can be considered as an integral part of a metallurgic installation.

As shown in FIG. 2(*b*), the coupling portion (1*c*) extends coaxially with the longitudinal axis (X), and has a maximum diameter (d1), with D1>d1. A shoulder (1*s*) of breadth (½ (D1−d1)) is thus formed by the distal end of the handling portion (1*h*) and the coupling portion (1*c*).

As shown in FIG. 2(*a*), the coupling portion (1*c*) is generally formed by,

- a fixed element (1*f*) fixed to or integral with the distal end of the handling portion (1*h*) and defining an exposed area of the distal end forming the shoulder (1*s*), and
- a probe holder (1*p*) extending along the longitudinal axis (X) and comprising a proximal end reversibly coupled to the fixed element (1*f*).

Like the handling portion, the coupling portion is generally hollow defining a passage for accommodating any wiring required by the probe (2*p*) positioned ata free end of the sublance (2). A free end of the coupling portion (1*c*) and, in particular, of the probe holder (1*p*), can be provided with an electrical connection (1*e*) (e.g., a male plug or a female socket) for coupling to a corresponding electrical connection (2*e*) of any wiring of the probe (2*b*) when a sublance (2) is coupled to the top lance (1*t*), thus forming an continuous electrically conductive communication extending from the probe (2*p*) along the passage through the top lance to any controller for recording the measurements by the probe (2*p*). Because the electrical connection (1*e*) of the probe holder (1*p*) can be damaged by repeated connections/disconnections to new sublances (2) and by the severe working conditions within a metallurgical vessel, very close to molten metal at very high temperatures and often exposed to vibrations, the probe holder (1*p*) must be changed at regular intervals, to ensure a good connection of any wires.

The probe holder (1*p*) can be reversibly coupled to the fixed element (1*f*) to form the coupling portion (1*c*) by mechanical means, such as a thread as illustrated in FIGS. 4(*a*) and 6(*a*), a bayonet, snap fits, and the like.

Sublance (2)

The sublance (2) extends along the longitudinal axis (X) and comprises a cavity (2*v*) configured for snugly receiving the coupling portion (1*c*). The sublance (2) is composed of at least,

- an elongated tube (2*t*) comprising an immersion end and a proximal end,
- a probe (2*p*) and/or a metal or slag sample collector are coupled to the immersion end of the elongated tube (2*t*), and
- a protective device (3) is coupled to the proximal end of the elongated tube (2*t*).

The cavity is substantially cylindrical of diameter (d2), with d1≤d2, extending along the longitudinal axis (X) from the immersion end at least partially closed by the probe (2*p*), to a coupling end (2*c*) of the protective device (3) which opens the cavity for receiving the coupling portion (1*c*) of the top lance (1*t*). The coupling portion (1*c*) of the top lance (1*t*) can comprise gripping means contacting the wall of the cavity (2*v*) and securing the sublance (2) by friction. The sublance (2) can also be secured to the coupling portion by mechanical means, such as a screw thread, a bayonet, snap fits, and the like.

An electrical connection (2*e*) mating the electrical connection (1*e*) of the coupling portion (1*c*) of the top lance can be fixed at a corresponding position in the cavity (2*v*), such that when the sublance (2) is coupled to the top lance (1*t*), an electrical communication is formed by connecting the electrical connectors (1*e*, 2*e*) of the top lance (1*t*) and of the sublance (2). This way, the probe (2*b*) can be electrically coupled to an external controller (not shown).

The elongated tube (2*t*) is generally made of cardboard closed by the probe at the immersion end thereof. The coupling end (2*c*) of the elongated tube (2*t*) of the sublance (2) generally has a substantially circular cross-section of external diameter (D2) wherein d1<d2<D2<D1. If the cross-sections of anyone of the coupling portion (1*t*), cavity (2*v*), coupling end (2*c*) of the sublance (2) or distal end of the handling portion (1*h*) are not circular, the cross-sections can be defined by the corresponding hydraulic diameters, dh1<dh2<Dh2<Dh1, wherein a hydraulic diameter is defined as a ratio of an area (A) to a perimeter (P) of the corresponding cross-section (Dh=A/P).

The gist of the present invention includes the provision of a protective device (3) fixed to the coupling end of the sublance (2). At rest, the protective device has an initial configuration, which substantially does not alter the external geometrical dimensions of the sublance. The protective device (3) can be deformed into a deformed configuration upon application thereon of a force parallel to the longitudinal axis (X). The force for deforming the protective device (3) must not substantially exceed the force normally applied for coupling a sublance (2) to a top lance (1*t*), and the protective device must be deformed from the initial configuration to the deformed configuration upon inserting the coupling portion (1*c*) of the top lance (1*t*) into the cavity (2*v*) until a free end of the protective device (3) contacts the shoulder (1*s*) of the top lance (1*t*) and, depending on the embodiments, upon deeper insertion of the coupling portion (1*c*) into the cavity (2*v*).

Coupling of the various components of a lance (1) according to the present embodiment of the invention can include coupling the probe holder (1*p*) to the fixed element (1*f*) to form the coupling portion (1*c*). The probe holder (1*p*) can be secured to the fixed element (1*f*) with a screw thread, a bayonet, snap fits, and the like. The coupling portion (1*c*) of the top lance (1*t*) can then be inserted coaxially into the cavity (2*v*) of the sublance (2), like a sword into a sheath until the protective device (3) in the initial configuration contacts the shoulder (2*h*). Upon application of a force along the longitudinal axis (X) onto the protective device (3), the protective device reaches the deformed configuration. It is essential to the present invention that the protective device (3) have reached the deformed configuration when coupling between the sublance (2) and the top lance (1*t*) is completed.

As shown in FIGS. 2(*d*), 4(*d*), and 6(*d*), when the sublance (2) is coupled to the top lance (1*t*), the protective device (3) is in the deformed configuration with the free end of the protective device contacting the shoulder (1*s*) and extends radially over an area inscribing a circle normal to the longitudinal axis (X) of diameter (D3*d*) with D3*d*≥D1, thus covering a whole area of the shoulder (1*s*). In the deformed configuration, the shoulder (1*s*) is sheltered by the protective device (3) from any molten metal splatters (11*s*) and needs not be scrubbed and scraped to remove any solidified metal from the surface of the shoulder (1*s*). Such cleaning operations must be made manually and can be very cumbersome.

Protective Device (3)—Double Tube

In a preferred embodiment illustrated in FIGS. 3(*a*) to 3(*e*), the protective device (3) comprises, an inner tube (3*i*) which is deformable upon application thereto of a compressive force along the longitudinal axis (X), the inner tube extending along the longitudinal axis (X) and forming an inner passage of diameter (D3*i*) with D3*i*≥d1, the inner layer (3*i*) comprising a number of inner slits (3*si*) separated from one another and distributed over a circumference of the inner tube (3*i*), an outer tube (3*o*) which is deformable upon application thereto of a compressive force along the longitudinal axis (X), the outer tube snugly surrounding the inner tube (3*i*) and comprising a number of outer slits (3*so*) separated from one another and distributed over a circumference of the outer tube (3*o*).

wherein the inner slits (3*si*) and the outer slits (3*so*) do not overlap with one another at any point.

The protective device (3) can optionally comprise one or more peripheral tubes which are deformable upon application thereto of a compressive force along the longitudinal axis (X), and which are inserted in one another and snugly surrounding the outer tube (3*o*) and wherein each of the one or more peripheral tubes comprises a number of peripheral slits separated from one another and distributed over a circumference of each of the one or more peripheral tubes, wherein the peripheral slits of two adjacent peripheral tubes do not overlap with one another at any point, and wherein the outer slits (3*so*) do not at any point overlap with the peripheral slits of the peripheral tube adjacent to the outer tube.

As shown in FIG. 4(*e*), the non-overlapping inner and outer slits (3*si*, 3*so*) are essential to the present invention for the following reasons. In the initial configuration, the protective device has an outer maximum diameter (D3*o*) yielding a perimeter Pi=π×D3*o*, formed by a number of stripes of material having a stripe width measured tangentially (i.e., normal to the longitudinal axis (X) and to a radial direction), defined between two adjacent slits of initial slit width. In the deformed configuration, the protective device (3) forms a surface spanning over an area inscribing a circle of diameter (D3*d*), with D3*o*<D3*d*, yielding a perimeter Pd=π×D3*d*>Pi. Since the stripe width remains constant upon flexing the stripes of material, Pd can be larger than Pi only by accordingly increasing the slit width. The problem with locally broad slits (3*si*, 3*so*) is that with such openings the surface thus formed cannot be impervious to splatters (11*s*) of molten metal and slag. For this reason, both inner tube (3*i*) and outer tube (3*o*) are required with inner slits (3*si*) and outer slits (3*so*) which do not overlap with one another at any point so that any locally broad slit of the inner or the outer tube is always covered by a stripe of material of the outer or the inner tube, respectively, thus defining a surface impervious to splatters (11*s*) of metal or slag.

As illustrated in FIGS. 3(*a*) to 3(*e*), the inner slits (3*si*) and outer slits (3*so*) can extend parallel to the longitudinal axis (X). Alternatively, as shown in FIG. 3(*f*), the inner slits (3*si*) and outer slits (3*so*) may extend transverse to, but not normal to the longitudinal axis. In this embodiment, the inner slits (3*si*) and outer slits (3*so*) may form an angle with the longitudinal axis comprised between 10 and 50°, preferably between 25 and 45°.

FIG. 3(*c*) illustrates an embodiment wherein the inner tube (3*i*) and/or the outer tube (3*o*) is provided with folding lines (3*f*) to control the deformation of the protective device (3) for folding in a reproducible way. The folding lines ensure that the tubes deform preferentially along the folding lines (3*f*). The folding lines (3*f*) can be formed by dotted perforations of the tubes, by a locally thinner wall thickness of the inner and/or outer tubes, the folding lines being thus defined by corresponding grooves. Since the protective device (3) is coupled at one end to the proximal end of the extended tube (2*t*) and at the coupling end (2*c*) to the coupling portion of the top lance (1*t*), folding lines (3*f*) can run adjacent and parallel to the one end and to the coupling end (2*c*) of the protective device (3). Folding lines (3*f*) can also run circumferentially at about mid-height of the protective device (3) to ensure that in the deformed configuration, the protective device (3) spans over the whole area of the shoulder. Preferred positions of folding lines (3*f*) as described supra are illustrated in FIGS. 3(*c*) and 4(*e*).

As shown in FIG. 3(*d*), the inner tube (3*i*) and the outer tube (3*o*) can have different heights measured along the longitudinal axis (X). In the embodiment of FIG. 3(*d*), the outer tube (3*o*) is about half the height of the inner tube (3*i*). In the embodiment of FIG. 3(*d*), the outer slits (3*so*) of the outer tube open at the free edge of the outer tube (3*o*) located closest to the coupling end (2*c*). Outer slits (3*so*) opening at the free edge of the outer tube (3*o*) located closest to the coupling end (2*c*) can also be applied to any outer tube (3*o*) having a height comprised between 50% and 100% of the height of the inner tube (3*i*). With this configuration, the inner tube folds in two and spreads the free stripes of material of the outer tube, which open like the petals of a flower.

The spaces between two adjacent stripes (=petals) of the outer tube are protected by stripes of material of the inner tube (3*i*) which are offset relative to the ones of the outer tube.

The protective device (3) can be cylindrical as shown in FIGS. 3(*a*) to 3(*d*) and 3(*f*) or it can comprise one or more cylindrical portions and one or more tapered or curved portions distributed along the longitudinal axis (X), an embodiment of which is illustrated in FIG. 3(*e*).

The inner tube (3*i*) and outer tube (3*o*) can be made of an elastomeric material or of a metal which is plastically deformable or can be in the form of a fabric of woven or non-woven fibres made of ceramic, polymer, or metal fibres.

FIGS. 4(*a*) to 4(*d*) illustrate various steps for mounting a lance according to the present embodiment of the invention, highlighting the deformation of the protective device (3) upon coupling the sublance (2) to the top lance (1*t*). FIG. 4(*a*) shows how to couple a probe holder (1*p*) to the fixed element (1*f*) to form the coupling portion (1*c*) of the top lance (1*t*). In FIG. 4(*a*) a screw thread is illustrated for coupling the probe holder (1*p*) to the fixed element (1*f*). As discussed supra, other coupling means can be used without affecting the present invention, such as a bayonet, or snap fits. As shown in FIGS. 4(*b*) and 4(*c*), the coupling portion (1*c*) of the top lance (1*t*) is inserted into the cavity (2*v*) of the sublance (2), like a sword into a sheath until the coupling end (2*c*) of the protective device contacts the shoulder (1*s*) without deformation of the protective device which is still in the initial configuration. The protective device (3) illustrated in FIGS. 4(*b*) to 4(*e*) is of the type illustrated in FIG. 3(*b*) or 3(*c*), but the same principle applies to any one of the embodiments illustrated in FIGS. 3(*b*) to 3(*f*). At this stage, illustrated in FIG. 4(*c*), the sublance (2) is not fully coupled to the top lance (1*t*) yet. To complete the coupling, the coupling portion (1*c*) must penetrate further, deeper into the cavity, which applies a compressive force along the longitudinal axis (X) onto the protective device (3) which is deformed to reach the deformed configuration. By comparing FIGS. 4(*d*) and 4(*e*), it can be seen that upon application of a compressive force along the longitudinal axis (X), the two-tube substantially cylindrical protective device buckles at mid-height (measured along the longitudinal axis (X)) forming a geometry of the type comprising two inverted funnels joined to one another at a broad end of each funnel. The diameter (D3*d*) at the level of the folding of the stripes of materials must be at least equal to the diameter (D2) of the distal end of the top lance (D3*d*≥D2). Consequently, the height of the protective device (3) measured along the longitudinal axis (X) must be larger than twice the radial breadth (=½ (D1−D2*c*)) of the shoulder (1*s*) formed between the top lance (1*t*) and the sublance (2), wherein D2*c* is the diameter of the coupling end (2*c*) of the protective device (3).

Protective Device (3)—Single Tube

Figure 7A:
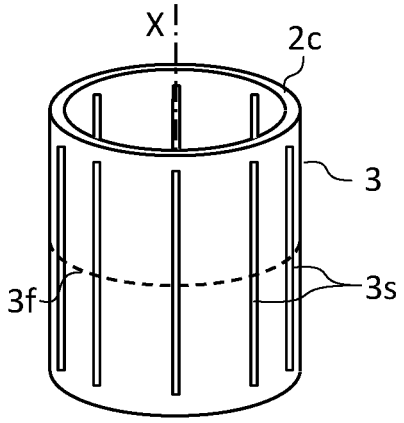
FIGS. 7(*a*) & 7(*b*) show alternative embodiments of protective devices according to the present invention.
Figure 7B:
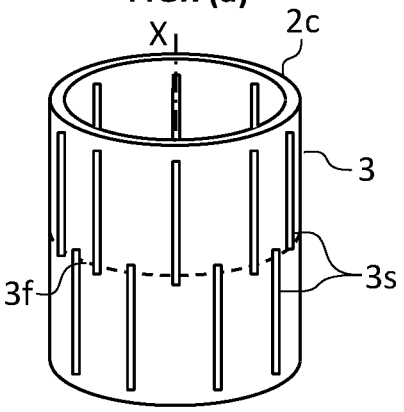
Figure 6B:
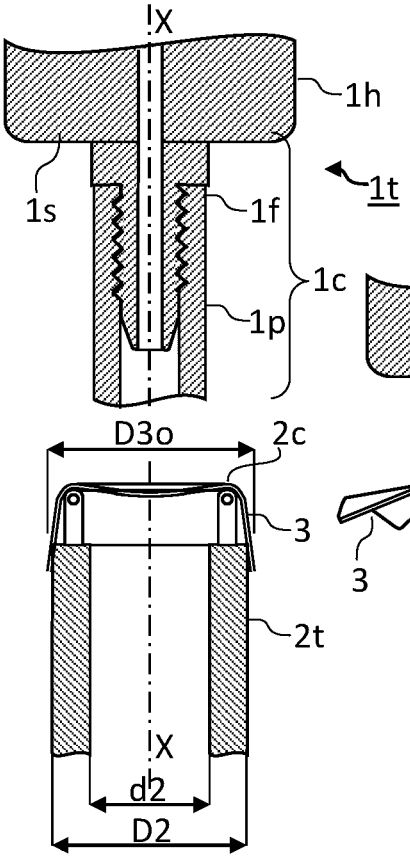
Figure 6C:
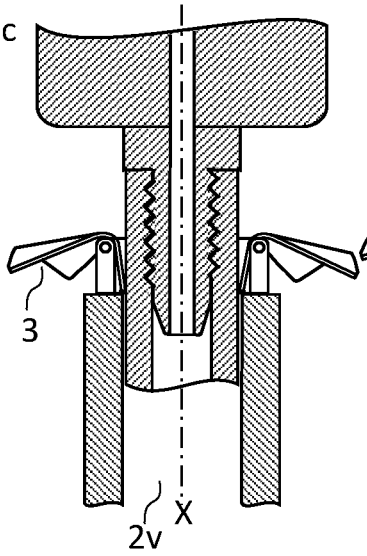
Figure 6D:
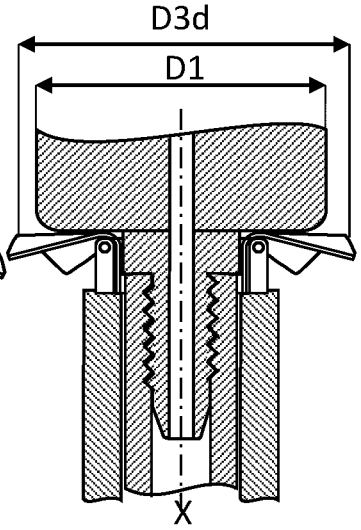

In an alternative preferred embodiment illustrated in FIGS. 7(*a*) and 7(*b*), the protective device (3) comprises a single tube which is deformable upon application thereto of a compressive force along the longitudinal axis (X). The tube extends along the longitudinal axis (X) and forms an inner passage of diameter (D3*i*) with D3*i*≤d1. The tube (3*i*) comprises a number of slits (3*s*) separated from one another and distributed over a circumference of the tube.

In the embodiment illustrated in FIG. 7(*a*), the slits extend over at least 70%, preferably at least 80%, more preferably at least 90% of a height of the tube measured along the longitudinal axis (X).

In the embodiment illustrated in FIG. 7(*b*), the slits (3*s*) are distributed in two sets, an upper set extending from a location adjacent to the coupling end (2*c*) to a location adjacent to a half of a height of the tube measured along the longitudinal axis (X), and a lower set extending from a location adjacent to a fixed end opposite the coupling end (2*c*) to a location adjacent to the half of the height of the tube, wherein the slits (3*s*) of the upper set are offset relative to the slits (3*s*) of the lower set.

The slits (3*s*) may extend parallel to the longitudinal axis (X) or, alternatively, they can extend transverse to, but not normal to the longitudinal axis (X). In the latter embodiment, the slits (3*s*) form an angle with the longitudinal axis preferably comprised between 10 and 50°, more preferably between 25 and 45°. In all cases, the slits are preferably parallel to each other or, at least, never cross each other.

As shown in FIGS. 7(*a*) and 7(*b*), the tube is preferably provided with folding lines (30*f*) to control the deformation of the protective device (3) for folding in a reproducible way. For example, a folding line (3*f*) can extend circumferentially at half the height of the tube.

The tube can be cylindrical or can comprise one or more cylindrical portions and one or more tapered or curved portions distributed along the longitudinal axis (X). The tube is preferably made of an elastomeric material, or of a metal which is plastically deformable, or is in the form of a fabric of woven or non-woven fibers made of ceramic, polymer, or metal fibers.

Protective Device (3)—Lotus Flower

In an alternative preferred embodiment illustrated in FIGS. 5(*a*) to 5(*e*), the protective device (3) comprises, a support ring (3*r*) coupled to the coupling end (2*c*) of the sublance (2), and a number of L-shaped plates (3*p*), each comprising an outer portion (3*po*) joined to an inner portion (3*pi*) at a level of a corner of the L (cf. FIG. 5(*a*)).

The L-shaped plates are rotatably mounted and distributed about a circumference of the support ring by hinges (3*h*) at the level of or adjacent to the corners of the L-shaped plates, such that, as shown in FIG. 5(*b*), the protective device (3) can change between initial and deformed configurations by rotation of the L-shaped plates (3*p*) about their respective hinges (3*h*).

In the initial configuration of the protective device (3) illustrated in FIG. 5(*c*), each L-shaped plate is biased to rotate such that the inner portions (3*pi*) extend radially inwards, substantially normal to the longitudinal axis (X), obturating at least partially the cavity (2*v*) and the outer portions (3*po*) rest against an outer surface of the sublance (2). In the initial configuration, the inner portions (3*pi*) form an inner passage of diameter (D3*i*) with D3*i*<d1. The bias can be created with a spring forcing the L-shaped plates into the initial configuration described supra. The bias can, however, be created much more simply by moving the centre of gravity of the L-shaped plates such that by gravity the L-shaped plates naturally rotate to reach the foregoing configuration. Note that the sublance is generally stored, handled, and used with the longitudinal axis (X) being substantially vertical, so that the effects of gravity can easily be controlled.

As shown in FIG. 5(*b*), the L-shaped plates are configured for pivoting about the hinges (3*h*) from the initial configuration illustrated in FIG. 5(*c*) to the deformed configuration illustrated in FIG. 5(*d*) upon inserting the coupling portion (1*c*) into the cavity (2*v*) to couple the sublance (2) to the top lance (1*t*). As shown in FIG. 5(*d*), in the deformed configuration, the inner portions (3*pi*) are aligned parallel to the longitudinal axis (X) and the outer portions (3*po*) extend radially, substantially normal to the longitudinal axis (X) and overlap with one another to form a continuous screen against metal splatters when the protective device (3) is brought into contact with the shoulder (1*s*).

As can be seen in FIGS. 5(*a*) and 5(*d*), each outer portion (3*po*) preferably has a free edge which is larger than the corner, measured tangentially (i.e., normal to the longitudinal axis (X) and to the radial directions). This way, when the L-shaped plates (3*p*) pivot about their hinges to reach the deformed configuration (like a blossoming lotus flower), all L-shaped plates contact the adjacent L-shaped plates positioned on either side thereof, thus forming a continuous screen protecting the shoulder (1*s*) against splattering.

Each outer portion (3*po*) is preferably curved with a curvature matching the external diameter (D2) of the coupling end (2*c*), such that when the protective device (3) is in the initial configuration, each outer portion (3*po*) mates an external surface of the sublance (2). This is illustrated in FIGS. 5(*c*) and 5(*e*), so that the maximum diameter (D3*o*) of the protective device (3) does not exceed D2 by more than 10% (D3*o*≤1.1 D2).

In a preferred embodiment, each inner portion (3*pi*) has a free edge which is shorter than the corner, measured normal to the longitudinal axis (X), as can be seen in FIGS. 5(*a*) to 5(*c*). This way, when the protective device (3) is in the initial configuration and the inner portions (3*pi*) extend radially inwards, they do not overlap with one another. They need not form a continuous screen, as in the initial configuration the sublance is not coupled to the top lance and is therefore not in use. When the L-shaped plates pivot to reach the deformed configuration, they contact the wall of the cavity, and should preferably not overlap with one another to allow as large a cavity opening as possible to admit the coupling portion (1*c*) of diameter (d1) into the cavity (2*v*).

Each inner portion (3*pi*) is preferably curved with a curvature matching the maximum diameter (d1) of the coupling portion (1*c*), such that upon inserting the coupling portion (1*c*) into the cavity (2*v*) and upon pivoting the L-shaped plates (3) over their hinges (3*h*), the inner portions (3*pi*) are pressed against a wall of the cavity (2*v*) and form an inner passage of diameter (D3*i*) with D3*i*≥d1, allowing the insertion of the coupling portion (1*c*).

The L-shaped plates (3) are preferably rigid enough to not substantially deform upon normal use of the device. In particular, when the coupling portion (1*c*) is introduced into the cavity (2*v*) and presses onto the inner portions (3*pi*) of the L-shaped plates, the inner portions must not bend (substantially) and must be rigid enough to drive the rotation of the L-shaped plates without bending. The L-shaped plates are preferably made of metal, preferably steel or aluminium, or made of a ceramic material, or made a polymeric material, preferably nor a rubbery polymer.

FIGS. 6(*a*) to 6(*d*) illustrate various steps for coupling of the various components of a lance according to the present embodiment of the invention, highlighting the deformation of the protective device (3) upon coupling the sublance (2) to the top lance (1*t*). FIG. 6(*a*) shows how the top lance (1*t*) is formed by coupling the probe holder (1*p*) to the fixed element (1*f*) to form the coupling portion (1*c*). In FIG. 6(*a*) a screw thread is illustrated for coupling the probe holder (1*p*) to the fixed element (1*f*). As discussed supra, other coupling means can be used without affecting the present invention, such as a bayonet, or snap fits. As shown in FIGS. 6(*b*) and 6(*c*), the coupling portion (1*c*) of the top lance (1*t*) is inserted into the cavity (2*v*) of the sublance (2), like a sword into a sheath. In the initial configuration, the inner portions (3*pi*) of the L-shaped plates (3*p*) extend inwards radially, partially obturating the opening of the cavity (2*v*), leaving an opening of diameter lower than the diameter (d1) of the coupling portion (1*c*). Consequently, as the coupling portion (1*c*) contacts the inner portions (3*pi*) of the L-shaped plates (3*p*), it applies a forces along the longitudinal axis (X) onto the inner portions, which pushes them downwards against the wall of the cavity (2*v*), thus driving the tilting of the L-shaped plates (3*p*), lifting at the same time the outer portions (3*po*) off the outer wall of the sublance (2). At the stage illustrated in FIG. 6(*c*), the protective device may or may not yet have reached the deformed configuration, depending on how far the inner portions (3*pi*) are pushed against the wall of the cavity (2*v*). At this stage, the sublance (2) is not fully coupled to the top lance (1*t*) yet, since the coupling end (2*c*) thereof does not contact the shoulder (1*s*). To complete the coupling, the coupling portion (1*c*) must penetrate further, deeper into the cavity. It is essential to the present invention that the protective device (3) have reached the deformed configuration when coupling between the sublance (2) and the top lance (1*t*) is completed. To fully open the "lotus flower", and bring the outer portions (3*po*) side by side forming a continuous screen, the coupling portion (1*c*) can be tapered, with the diameter of the coupling portion increasing until reaching the maximum diameter (d1) at a top section thereof, which is adjacent to the handling portion (1*c*), to fully press the inner portions against the wall of the cavity (2*v*).

Conclusive Remarks

The various aspects of the present invention including a top lance (1*t*), a sublance (2), and a protective device (3) have in common a protective device characterized in that,

- when at rest, the protective device (3) is in an initial configuration characterized by an outer maximum diameter (D3*o*) which is not more than 10% larger than D2 (D3*o*≤1.1 D2), preferably not more than 5% larger than D2 (D3*o*≤1.05 D2), more preferably D3*o*=D2,
- when the sublance (2) is coupled to the lance with the coupling portion (1*c*) being inserted in the cavity (2*v*), the protective device (3) contacts the shoulder (1*s*) and is deformed into a deformed configuration, forming a surface impervious to molten metal and slag, which spans over an area inscribing a circle of diameter (D3*d*) with D3*d*≥D1, covering a whole area of the shoulder (1*s*), extending normal to the longitudinal axis (X) over a distance at least equal to ½ D1 from the longitudinal axis (X).

This apparently simple solution yields great advantages in terms of maintenance of the lance, as there is no need to scrape off any solidified metal or slag splatter soiling the shoulder (1*s*) of the top lance (1*t*). At the same time, a sublance of the prior art can be replaced by a sublance (2) of the present invention without altering anything in the process, neither the rack storing spare sublances (2), nor the programming of the robot handling the sublances. This is made possible, because in the initial configuration, the protective device (3) does not alter substantially the geometry of the sublance. This solution is also quite economical to implement.

| REF | DESCRIPTION |
|---|---|
| 1 | Lance |
| 1c | Coupling portion |
| 1e | Electrical coupling of disposable probe holder |
| 1f | Fixed element |
| 1h | Handling portion |
| 1p | Disposable probe holder |
| 1s | Shoulder |
| 1t | Top lance |
| 2 | Sublance |
| 2c | Coupling end of the sublance |
| 2e | Electrical coupling of sublance |
| 2p | Probe |
| 2t | Elongated tube |
| 2v | Cavity |
| 3 | Protective device |
| 3f | Folding line |
| 3h | Hinge |
| 3i | Inner tube |
| 3o | Outer tube |
| 3p | L-shaped plate |
| 3pi | Inner portion of the L-shaped plate |
| 3po | Outer portion of the L-shaped plate |
| 3r | Support ring |
| 3si | Inner slit |
| 3so | Outer slit |
| 10 | Metallurgic vessel (e.g., converter) |
| 11 | Molten metal |
| 11s | Splashes |
| 12 | Gas lance (e.g., oxygen lance) |
| d1 | Maximum diameter of the coupling portion cross-section |
| D1 | Diameter of the cross-section of distal end of the handling portion |

-continued

| REF | DESCRIPTION |
|---|---|
| d2 | Diameter of cavity |
| D2 | External diameter of the coupling end |
| D3d | Outer maximum diameter of the deformed protective device |
| D3i | Diameter of inner passage of the protective device |
| D3o | Outer maximum diameter of the undeformed protective device |
| X | Longitudinal axis |

The invention claimed is:

1. Lance for immersion of a probe into molten metal comprising, (A) a top lance comprising, a handling portion extending along a longitudinal axis (X), and comprising a distal end of cross-section normal to the longitudinal axis (X) of diameter (D1), the distal end being provided with a coupling portion extending coaxially with the longitudinal axis (X), and having a maximum diameter (d1), with D1>d1, (B) a sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end (2 *c*) opening to the cavity (2 *v*), wherein, the elongated tube (2 *t*) has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting a shoulder formed by the distal end of the handling portion and the coupling portion, wherein when at rest, the protective device is in an initial configuration characterized by an outer maximum diameter (D3 *o*) which is not more than 10% larger than D2 (D3 *o*≤1.1 D2), when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3 *d*) with D3 *d*≥D1, covering a whole area of the shoulder.

2. A sublance for coupling to the coupling portion of the lance according to claim 1, wherein the sublance is formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end opening to the cavity, wherein, the elongated tube has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting the shoulder, wherein, when at rest, the protective device is in an initial configuration characterized by an outer maximum diameter which is not more than 10% larger than D2 (D3 *o*≤1.1 D2), when the sublance is coupled to the lance with the coupling portion (1 *c*) being inserted in the cavity, the protective device contacts the shoulder and is deformed into a deformed configuration, forming a surface impervious to molten metal and slag, which spans over an area inscribing a circle of diameter (D3 *d*) with D3 *d*≥D1, covering a whole area of the shoulder, extending normal to the longitudinal axis (X) over a distance at least equal to ½D1 from the longitudinal axis (X).

3. Lance for immersion of a probe into molten metal comprising, (A) a top lance comprising, a handling portion extending along a longitudinal axis (X), and comprising a distal end of cross-section normal to the longitudinal axis (X) of diameter (D1), the distal end being provided with a coupling portion extending coaxially with the longitudinal axis (X), and having a maximum diameter (d1), with D1>d1, (B) a sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end (2 *c*) opening to the cavity (2 *v*), wherein, the elongated tube (2 *t*) has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting a shoulder formed by the distal end of the handling portion and the coupling portion, wherein when at rest, the protective device is in an initial configuration characterized by an outer maximum diameter (D3 *o*) which is not more than 10% larger than D2 (D3 *o*≤1.1 D2), when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3 *d*) with D3 *d*≥D1, covering a whole area of the shoulder;

wherein the protective device comprises, an inner tube which is deformable upon application thereto of a compressive force along the longitudinal axis (X), the inner tube extending along the longitudinal axis (X) and forming an inner passage of diameter (D3 *i*) with D3 *i*≥d1, the inner tube comprising a number of inner slits separated from one another and distributed over a circumference of the inner tube, an outer tube which is deformable upon application thereto of a compressive force along the longitudinal axis (X), the outer tube snugly surrounding the inner tube (3 *i*) and comprising a number of outer slits separated from one another and distributed over a circumference of the outer tube, optionally, one or more peripheral tubes which are deformable upon application thereto of a compressive force along the longitudinal axis (X), and which are inserted in one another and snugly surrounding the outer tube and wherein each of the one or more peripheral tubes comprises a number of peripheral slits separated from one another and distributed over a circumference of each of the one or more peripheral tubes, wherein the peripheral slits of two adjacent peripheral tubes do not overlap with one another at any point, and wherein the outer slits do not at any point overlap with the peripheral slits of the peripheral tube adjacent to the outer tube, and wherein the inner slits and the outer slits do not overlap with one another at any point.

4. Lance according to claim 3, wherein the inner slits and outer slits extend parallel to the longitudinal axis (X).

5. Lance according to claim 3, wherein the inner slits and outer slits extend transverse to, but not normal to the longitudinal axis (X), and wherein the inner slits and outer slits form an angle with the longitudinal axis comprised between 10 and 50°.

6. Lance according to claim 3, wherein the inner tube and outer tube are made of an elastomeric material, or of a metal which is plastically deformable, or is in the form of a fabric of woven or non-woven fibres made of ceramic, polymer, or metal fibres.

7. Lance according to claim 3, wherein one or more of: the inner tube and the outer tube is provided with folding lines to control the deformation of the protective device for folding in a reproducible way.

8. Lance according to claim 3, wherein the inner tube and the outer tube have different heights measured along the longitudinal axis (X).

9. Lance according to claim 3, wherein the protective device is one of: (1) cylindrical, (2) comprises a plurality of cylindrical portions, and (3) comprises one or more cylindrical portions and one or more tapered or curved portions distributed along the longitudinal axis (X).

10. Lance for immersion of a probe into molten metal comprising, (A) a top lance comprising, a handling portion extending along a longitudinal axis (X), and comprising a distal end of cross-section normal to the longitudinal axis (X) of diameter (D1), the distal end being provided with a coupling portion extending coaxially with the longitudinal axis (X), and having a maximum diameter (d1), with D1>d1, (B) a sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end (2 *c*) opening to the cavity (2 *v*), wherein, the elongated tube (2*t*) has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting a shoulder formed by the distal end of the handling portion and the coupling portion, wherein when at rest, the protective device is in an initial configuration characterized by an outer maximum diameter (D3 *o*) which is not more than 10% larger than D2 (D3 *o*≤1.1 D2), when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3 *d*) with D3 *d*≥D1, covering a whole area of the shoulder;

wherein the protective device comprises a tube which is deformable upon application thereto of a compressive force along the longitudinal axis (X), the tube extending along the longitudinal axis (X) and forming an inner passage of diameter (D3 *i*) with D3≥d1, the tube comprising a number of slits separated from one another and distributed over a circumference of the tube, wherein the slits are distributed in two sets, an upper set extending from a location adjacent to the coupling end to a location adjacent to a half of a height of the tube measured along the longitudinal axis (X), and a lower set extending from a location adjacent to a fixed end opposite the coupling end to a location adjacent to the half of the height of the tube, wherein the slits of the upper set are offset relative to the slits of the lower set.

11. Lance for immersion of a probe into molten metal comprising, (A) a top lance comprising, a handling portion extending along a longitudinal axis (X), and comprising a distal end of cross-section normal to the longitudinal axis (X) of diameter (D1), the distal end being provided with a coupling portion extending coaxially with the longitudinal axis (X), and having a maximum diameter (d1), with D1>d1, (B) a sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end (2 *c*) opening to the cavity (2 *v*), wherein, the elongated tube (2 *t*) has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting a shoulder formed by the distal end of the handling portion and the coupling portion, wherein when at rest, the protective device is in an initial configuration characterized by an outer maximum diameter (D3 *o*) which is not more than 10% larger than D2 (D3 *o*≤1.1 D2), when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3 *d*) with D3 *d*≥D1, covering a whole area of the shoulder;

wherein the protective device comprises, a support ring coupled to the proximal end of the elongated tube, and a number of L-shaped plates, each comprising an outer portion joined to an inner portion at a level of a corner of the L-shaped plates, the L-shaped plates being rotatably mounted and distributed about a circumference of the support ring by hinges at the level of or adjacent to the corners of the L-shaped plates, such that in the initial configuration of the protective device, each L-shaped plate is biased to rotate such that the inner portions extend radially inwards, substantially normal to the longitudinal axis (X), obturating at least partially the cavity and the outer portions rest against an outer surface of the sublance, and the L-shaped plates are configured for pivoting about the hinges from the initial configuration to the deformed configuration upon inserting the coupling portion into the cavity to couple the sublance to the top lance, wherein in the deformed configuration, the inner portions are aligned parallel to the longitudinal axis (X) and the outer portions extend radially, substantially normal to the longitudinal axis (X) and overlap with one another to form a continuous screen against splashes when the protective device is brought into contact with the shoulder.

12. Lance according to claim 11, wherein each outer portion has a free edge which is larger than the corner, measured normal to the longitudinal axis (X), and wherein each outer portion is curved with a curvature matching the external diameter (D2) of the coupling end, such that when the protective device is in the initial configuration, each outer portion mates an external surface of the sublance.

13. Lance according to claim 11, wherein each inner portion has a free edge which is shorter than the corner, measured normal to the longitudinal axis (X), and wherein each inner portion is curved with a curvature matching the maximum diameter (d1) of the coupling portion, such that upon inserting the coupling portion into the cavity and upon pivoting the L-shaped plates over their hinges, the inner portions are pressed against a wall of the cavity and form an inner passage of diameter with D3 *i*≥d1, allowing the insertion of the coupling portion.

14. Lance according to claim 11, wherein the L-shaped plates are rigid enough to not substantially deform upon normal use of the device, and are made of metal, or made of a ceramic material, or made a polymeric material.

15. Lance for immersion of a probe into molten metal comprising, (A) a top lance comprising, a handling portion extending along a longitudinal axis (X), and comprising a distal end of cross-section normal to the longitudinal axis (X) of diameter (D1), the distal end being provided with a coupling portion extending coaxially with the longitudinal axis (X), and having a maximum diameter (d1), with D1>d1, (B) a sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to a protective device comprising a coupling end (2 *c*) opening to the cavity (2 *v*), wherein, the elongated tube (2 *t*) has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting a shoulder formed by the distal end of the handling portion and the coupling portion, wherein when at rest, the protective device is in an initial configuration characterized by an outer maximum diameter (D3 *o*) which is not more than 10% larger than D2 (D3 *o*≤1.1 D2), when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3 *d*) with D3 *d*≥D1, covering a whole area of the shoulder;

wherein the protective device comprises, an inner tube which is deformable upon application thereto of a compressive force along the longitudinal axis (X), the inner tube extending along the longitudinal axis (X) and forming an inner passage of diameter (D3 *i*) with D3≥d1, the inner tube comprising a number of inner slits separated from one another and distributed over a circumference of the inner tube, an outer tube which is deformable upon application thereto of a compressive force along the longitudinal axis (X), the outer tube snugly surrounding the inner tube and comprising a number of outer slits separated from one another and distributed over a circumference of the outer tube, optionally, one or more peripheral tubes which are deformable upon application thereto of a compressive force along the longitudinal axis (X), and which are inserted in one another and snugly surrounding the outer tube and wherein each of the one or more peripheral tubes comprises a number of peripheral slits separated from one another and distributed over a circumference of each of the one or more peripheral tubes, wherein the peripheral slits of two adjacent peripheral tubes do not overlap with one another at any point, and wherein the outer slits do not at any point overlap with the peripheral slits of the peripheral tube adjacent to the outer tube, and wherein the inner slits and the outer slits do not overlap with one another at any point, wherein when the sublance is coupled to the lance with the coupling portion (1 *c*) being inserted in the cavity, the protective device contacts the shoulder and is deformed into a deformed configuration, forming a surface impervious to molten metal and slag, which spans over an area inscribing a circle of diameter (D3 *d*) with D3 *d*≥D1, covering a whole area of the shoulder, extending normal to the longitudinal axis (X) over a distance at least equal to ½ D1 from the longitudinal axis (X).

16. Protective device for protecting from splattering a shoulder formed between a distal end of a handling portion and a sublance of a lance for immersion of a probe into molten metal, the lance comprising (A) a top lance comprising, the handling portion extending along a longitudinal axis (X), and comprising the distal end of cross-section normal to the longitudinal axis (X) of diameter (D1), the distal end being provided with a coupling portion extending coaxially with the longitudinal axis (X), and having a maximum diameter (d1), with D1>d1, and (B) the sublance formed by an elongated tube extending along the longitudinal axis (X) and comprising a cavity configured for snugly receiving the coupling portion, wherein the cavity is substantially cylindrical of diameter (d2), with d1≤d2, extending along the longitudinal axis (X) from an immersion end provided with a probe and/or a sample collector, to a proximal end which is coupled to the protective device comprising a coupling end (2 *c*) opening to the cavity (2 *v*), wherein, the elongated tube (2 *t*) has a cross-section of external diameter (D2) wherein d1<d2<D2<D1, and the protective device (3) is deformable upon application thereto of a force along the longitudinal axis (X), and the coupling portion is inserted in the cavity of the sublance with the protective device contacting a shoulder formed by the distal end of the handling portion and the coupling portion, wherein when at rest, the protective device is in an initial configuration characterized by an outer maximum diameter (D3 *o*) which is not more than 10% larger than D2 (D3 *o*≤1.1 D2), when the sublance is coupled to the lance with the coupling portion being inserted in the cavity, the protective device contacts the shoulder and is deformed into a deformed configuration, forming a surface impervious to molten metal and slag, which spans over an area inscribing a circle normal to the longitudinal axis (X) of diameter (D3 *d*) with D3 *d*≥D1, covering a whole area of the shoulder;

wherein the protective device further comprises, an inner tube which is deformable upon application thereto of a compressive force along the longitudinal axis (X), the inner tube extending along the longitudinal axis (X) and forming an inner passage of diameter (D3 *i*) w with D3 *i*>d1, the inner tube comprising a number of inner slits separated from one another and distributed over a circumference of the inner tube, an outer tube which is deformable upon application thereto of a compressive force along the longitudinal axis (X), the outer tube snugly surrounding the inner tube and comprising a number of outer slits separated from one another and distributed over a circumference of the outer tube, optionally, one or more peripheral tubes which are deformable upon application thereto of a force along the longitudinal axis (X), and which are inserted in one another and snugly surrounding the outer tube and wherein each of the one or more peripheral tubes comprises a number of peripheral slits separated from one another and distributed over a circumference of each of the one or more peripheral tubes, wherein the peripheral slits of two adjacent peripheral tubes do not overlap with one another at any point, and wherein the outer slits do not at any point overlap with the peripheral slits of the peripheral tube adjacent to the outer tube, and wherein the inner slits and the outer slits do not overlap with one another at any point.

* * * * *